United States Patent [19]

Cummins et al.

[11] Patent Number: 4,602,461

[45] Date of Patent: Jul. 29, 1986

[54] INSULATED TRUSSED ROOF CONSTRUCTION

[75] Inventors: Gary L. Cummins, Edwardsburg, Mich.; Bradley W. Oberg, Granville, Ohio

[73] Assignee: Owens-Corning Fiberglas Corporation, Toledo, Ohio

[21] Appl. No.: 581,460

[22] Filed: Feb. 17, 1984

[51] Int. Cl.[4] ..... E04B 1/76; E04C 2/34

[52] U.S. Cl. ..... 52/90; 52/407; 52/639; 52/644; 52/650

[58] Field of Search ..... 52/407, 404, 86, 463, 52/639, 644, 795, 309.1, 406, 90, 643, 690, 807, DIG. 6, 650

[56] References Cited

U.S. PATENT DOCUMENTS

| | | | |
|---|---|---|---|
| 1,981,419 | 11/1934 | Kreutzer | 52/639 |
| 2,150,754 | 3/1939 | Williams | 52/644 X |
| 2,457,056 | 12/1948 | Macomber | 52/639 |
| 2,801,716 | 8/1957 | Colby | 52/86 |
| 3,875,650 | 4/1975 | Jackson | 52/644 X |
| 4,329,827 | 5/1982 | Thorn | 52/807 X |
| 4,348,850 | 9/1982 | Reeder et al. | 52/DIG. 6 |
| 4,488,390 | 12/1984 | Mulford | 52/407 |

FOREIGN PATENT DOCUMENTS

| | | | |
|---|---|---|---|
| 3028640 | 3/1982 | Fed. Rep. of Germany | 52/90 |
| 2333911 | 7/1977 | France | 52/90 |
| 207481 | 9/1966 | Sweden | 52/90 |

*Primary Examiner*—John E. Murtagh
*Assistant Examiner*—Richard E. Chilcot, Jr.
*Attorney, Agent, or Firm*—Ronald C. Hudgens; Ted C. Gillespie; Paul J. Rose

[57] ABSTRACT

The construction includes batts of fibrous insulation between trusses as well as insulation in a vertical thermal path through the trusses.

4 Claims, 15 Drawing Figures

INSULATED TRUSSED ROOF CONSTRUCTION

TECHNICAL FIELD

This invention relates generally to an insulated trussed roof construction, and more particularly to roof trusses adapted to enable provision of better insulated roofs or attics when batt-type insulation is used. The invention is especially suitable for mobile homes, but also useful in other types of dwellings with trussed roofs and batt-type insulation.

BACKGROUND ART

Standard trusses for a mobile home space a roof from inner ceiling panels sufficiently to allow installation of batts of glass fiber insulation between trusses. Conveniently, batts with a nominal thickness of two inches and an insulation value of R7 can be used. Less conveniently, and with some compression of the batts at opposite ends, batts with a nominal thickness of three and one-half inches and an insulation value of R11 can be used.

With the relatively low amount of thermal insulation in such constructions, the significance of the vertical heat flow path through the trusses themselves was not readily apparent. However, with recent emphasis on energy conservation, trusses have been made taller to provide more space between ceiling panels and the roof and thus allow more insulation to be installed, such as a nominal total thickness of eight to nine and one-half inches and an insulatiotn value of R25 to R30. With this relatively high amount of thermal insulation between trusses, the vertical heat flow path through the trusses results at these locales in a more significant, higher percentage of the total heat loss through the roof. The separation of the batts of insulation at the vertical posts or braces of the truss is particularly harmful to heat conservation.

DISCLOSURE OF INVENTION

In accordance with the invention, various constructions of trusses are provided for reducing the heat loss through the trusses.

BRIEF DESCRIPTION OF DRAWINGS

The invention is more fully explained hereinafter with reference to the accompanying drawings, wherein.

BEST MODE OF CARRYING OUT THE INVENTION

Figure 1:
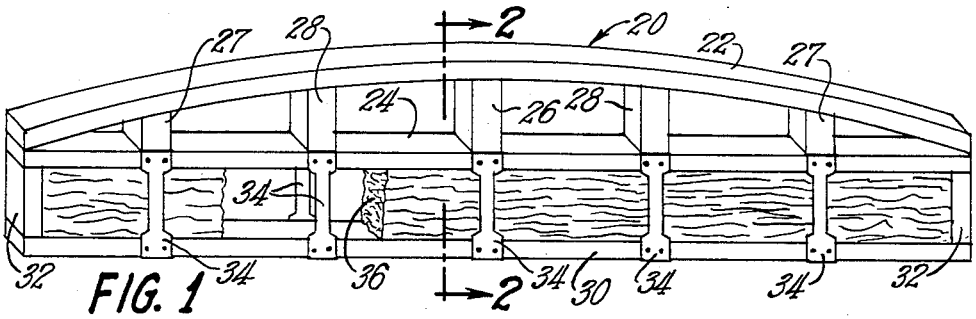
FIG. 1 is a perspective view of a mobile home roof truss constructed in accordance with the invention.

With respect to the drawings, a mobile home roof truss 20 of the invention is shown in FIG. 1. The truss 20 includes an upper curved chord or beam 22 and an intermediate straight chord or beam 24 joined by a plurality of horizontally spaced vertical web members or posts including a relatively tall center post 26, a pair of relatively short opposite end posts 27, and a pair of intermediate posts 28. The beams 22 and 24 and posts 26–28 may be said to constitute a standard bow truss. A lower straight chord or beam 30 is connected to the beam 24 by a pair of opposite end posts 32 and a plurality of metal struts 34. The struts 34 are located on opposite sides of the beams 24 and 30, one pair being disposed below each of the posts 26–28. A specially cut strip of standard glass fiber building insulation 36 such as made by Owens-Corning Fiberglas Corporation is installed in the space defined by the beams 24 and 30, the end posts 32, and the struts 34.

Figure 2:
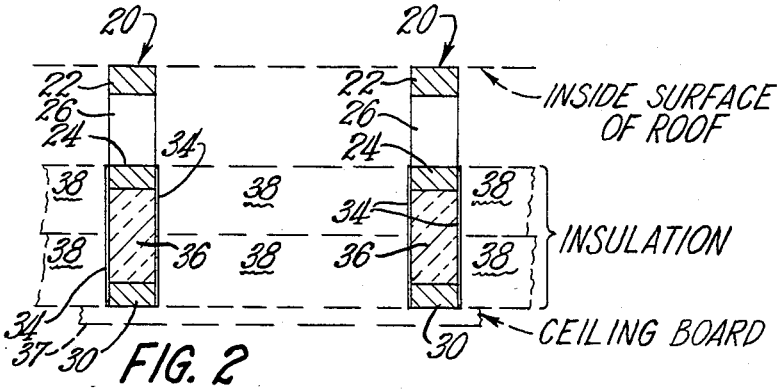
FIG. 2 is a sectional view taken generally in the direction of arrows 2—2 of FIG. 1, but with appropriate additions to represent a fragmentary sectional view of a mobile home roof.

FIG. 2 represents a fragmentary sectional view of a mobile home roof having trusses 20 like that of FIG. 1, two of the trusses being shown. Ceiling board 37 is secured to the lower beams 30 of the trusses and glass fiber insulation batts 38, such as manufactured by Owens-Corning Fiberglas Corporation and shown as two layers in this embodiment, are installed between the trusses 20 above the ceiling board 37. By way of example, the trusses 20 might be mounted on sixteen-inch centers and have a width of one and one-half inches. The batts 38, which are compressible, might have a nominal width of fifteen inches. It will be observed that with this arrangement, a vertical heat flow path through each truss 20 passes through the insulation 36, and the insulation 36 of each truss 20 is in firm engagement on opposite sides respectively with the batts 38 all along the truss, except at the struts 34. The struts 34 are engaged on their inner sides with the insulation 36 and on their outer sides with the batts 38.

Figure 2A:
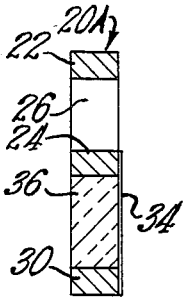
FIG. 2A is a sectional view of a mobile home roof truss similar to those of FIGS. 1 and 2, but illustrating a preferred embodiment.

FIG. 2A shows a truss 20A which is a preferred embodiment of the trusses 20 of FIGS. 1 and 2. The truss 20A has struts 34 on only one side and the insulation 36 is retained therein by friction, being slightly oversize in a vertical direction.

Figure 3:
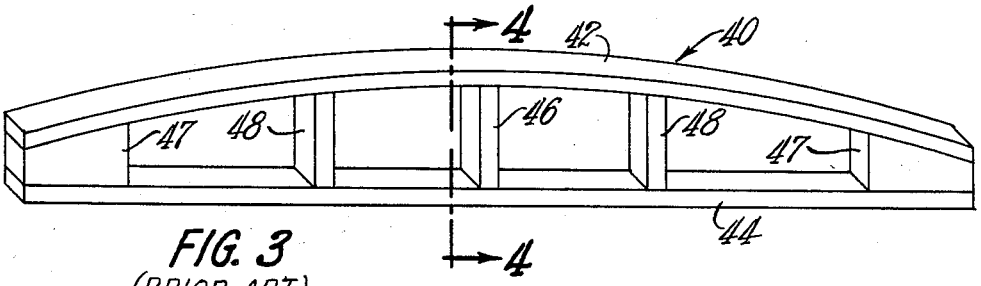
FIG. 3 (PRIOR ART)
FIG. 3 is a perspective view of a conventional mobile home roof truss.

FIG. 3 shows a truss 40 of the prior art. The truss 40 includes an upper curved beam 42 and a lower straight beam 44 joined by a plurality of horizontally spaced support members including a relatively tall center post 46, a pair of opposite generally wedge-shaped end members 47, and a pair of intermediate posts 48.

Figure 4:
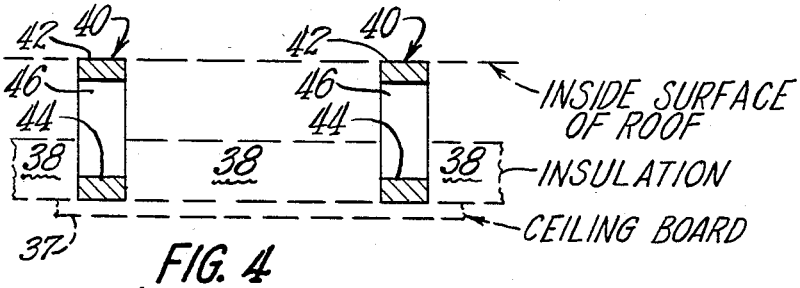
FIG. 4 (PRIOR ART)
FIG. 4 is a sectional view taken generally in the direction of arrows 4—4 of FIG. 3, but with appropriate additions to represent a fragmentary sectional view of a mobile home roof.

FIG. 4 shows a fragmentary sectional view of a mobile home roof constructed with such prior trusses 40, two of the trusses being shown. Ceiling board 37 is secured to the lower beams 44 of the trusses, and glass fiber insulation batts 38 are installed between the trusses 40 above the ceiling board 37. By way of example, the trusses 40 might be mounted on sixteen-inch centers and have a width of one and one-half inches. The batts 38, which are compressible, might have a nominal width of fifteen inches. It will be observed that with this arrangement, a vertical heat flow path through each truss 40 may encounter no glass fiber insulation. More specifically, the lower beam 44 and the posts and wedges 46-48 keep the batts 38 apart, resulting in a high heat loss through the trusses 40 compared to that through the rest of the roof between the trusses and also compared to that through the trusses 20 and other embodiments of the invention described hereinafter, all of this assuming lower temperatures outside than inside a mobile home.

Figure 5:
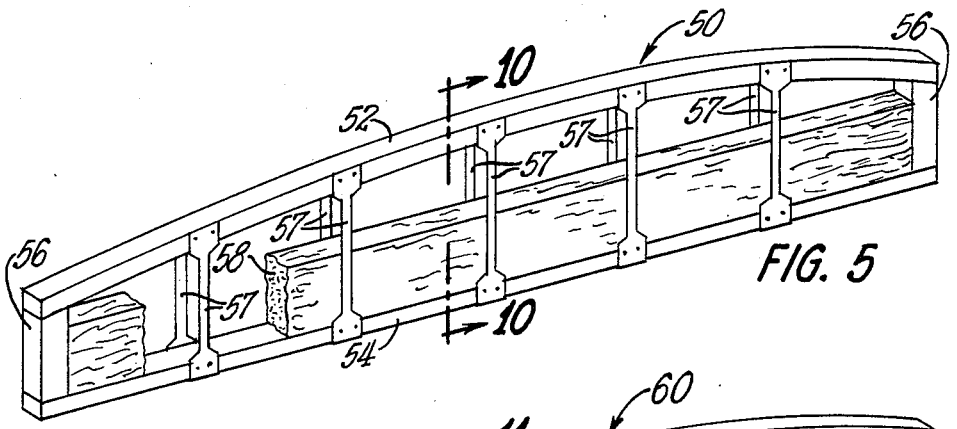
FIGS. 5, 6, 7, 8, and 9 are perspective views of mobile home roof trusses constructed in accordance with the invention and illustrating alternative embodiments.

FIGS. 5–9 show alternative embodiments of the invention. FIG. 5 shows a truss 50 including an upper curved beam 52 and a lower straight beam 54 joined by a pair of opposite end posts 56 and a plurality of metal struts 57 spaced horizontally along opposite sides of the beams 52 and 54. A specially cut strip of glass fiber building insulation 58 is installed in the space defined by the upper and lower beams 52 and 54, the end posts 56, and the struts 57.

Figure 6:
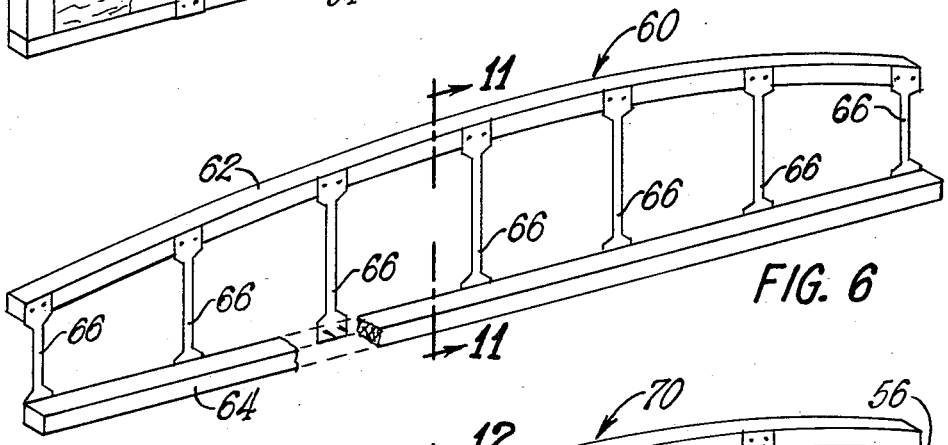

FIG. 6 shows a truss 60 with an upper curved beam 62 and a lower straight beam 64 transversely offset from each other and connected by a plurality of horizontally spaced metal struts 66.

Figure 7:
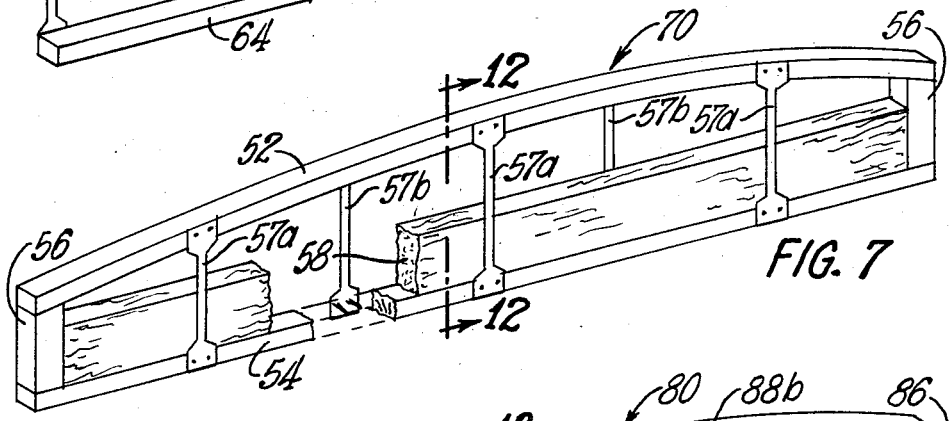

FIG. 7 shows a truss 70 similar to the truss 50 but with only half as many horizontally spaced metal struts 57. One strut 57 of each pair of opposed struts of the truss 50 has been omitted on the truss 70, and the remaining struts are alternately disposed on opposite sides of the beams 52 and 54, as shown by the indicia 57*a* and 57*b* in FIG. 7, the struts 57*a* being on one side of the beams and the struts 57*b* being on the other side of the beams 52 and 54.

Figure 8:
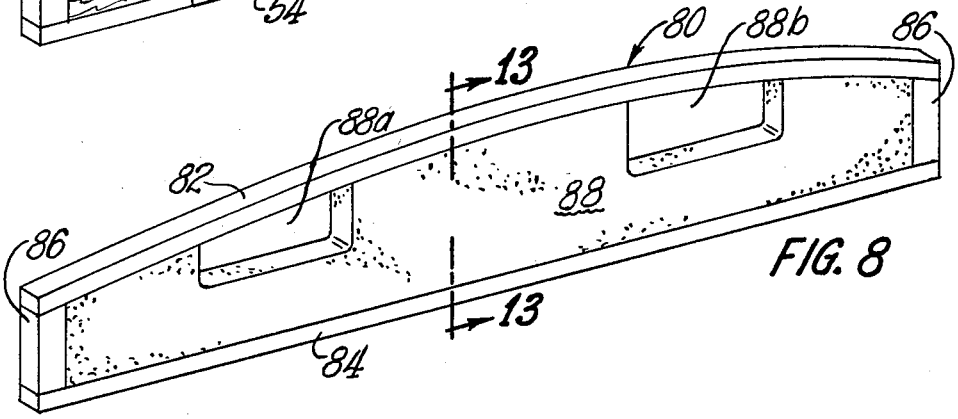

FIG. 8 shows a truss 80 including an upper curved beam 82 and a lower straight beam 84 joined by a pair of opposite end posts 86. Plastic foam 88 fills the space defined by the beams 82 and 84 and the posts 86, except for a pair of openings 88*a* and 88*b* provided for passage of pipes and wiring through the truss.

Figure 9:
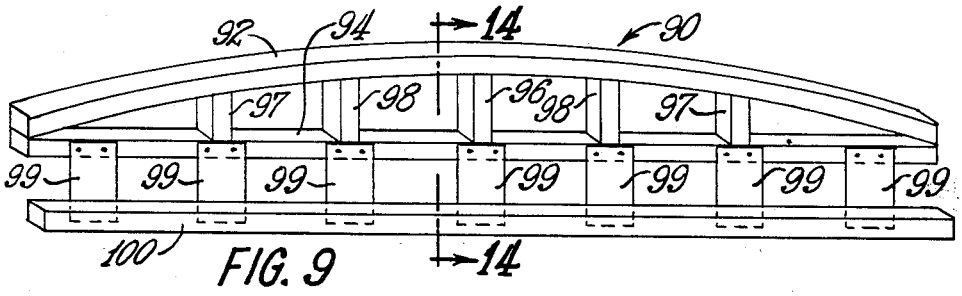

FIG. 9 shows a truss 90 including an upper curved beam 92 and an intermediate straight beam 94 joined by a plurality of horizontally spaced vertical support posts including a relatively tall center post 96, a pair of relatively short opposite end posts 97, and a pair of intermediate posts 98. A lower straight beam 100 is transversely offset from the beams 92 and 94 and joined to the beam 94 by a plurality of horizontally spaced rectangular plywood or metal plates 99.

Figure 10:
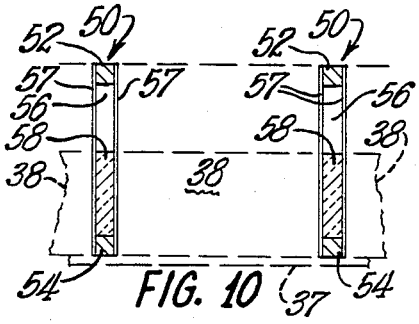
FIGS. 10, 11, 12, 13, and 14 are sectional views respectively taken generally in the direction of arrows 10—10 of FIG. 5, 11—11 of FIG. 6, 12—12 of FIG. 7, 13—13 of FIG. 8, and 14—14 of FIG. 9, but with appropriate additions to represent fragmentary sectional views of mobile home roofs.

FIG. 10 shows a fragmentary sectional view of a mobile home roof having trusses 50 like that of FIG. 5, two of the trusses being shown. Ceiling board 37 is secured to the lower beams 54 of the trusses, and glass fiber insulation batts 38 are installed between the trusses 50 above the ceiling board 37. By way of example, the trusses 50 might be mounted on sixteen-inch centers and have a width of one and one-half inches. The batts 38, which are compressible, might have a nominal width of fifteen inches. It will be observed that with this arrangement, a vertical heat flow path through each truss 50 passes through the insulation 58, and the insulation 58 of each truss 50 is in firm engagement on opposite sides respectively with the batts 38 all along the truss, except at the struts 57. The struts 57 are engaged on their inner sides with the insulation 58 and on their outer sides with the batts 38.

Figure 11:
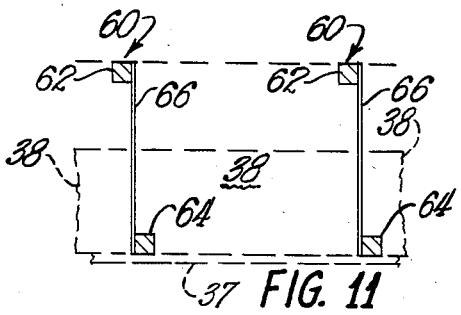

FIG. 11 shows a fragmentary sectional view of a mobile home roof having trusses 60 like that of FIG. 6, two of the trusses being shown. Ceiling board 37 is secured to the lower beams 64 of the trusses, and glass fiber insulation batts 38 are installed between the trusses 60 above the ceiling board 37. By way of example, the trusses 60 might be mounted on sixteen-inch centers and the batts 38, which are compressible, might have a nominal width of sixteen and one-half inches. It will be observed that with this arrangement, the batts 38 on opposite sides of the struts 66 of each truss 60 are in firm engagement with each other all along the truss, except at the struts 66, and a vertical heat flow path through either the upper beam 62 or the lower beam 64 of the truss passes through a respective one of the batts 38.

Figure 12:
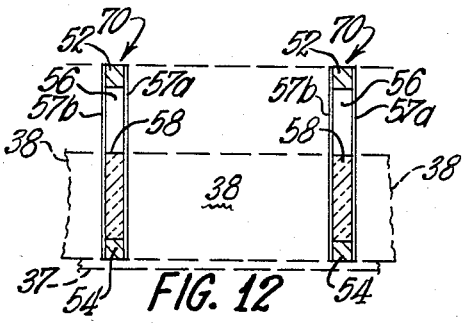

FIG. 12 shows a fragmentary sectional view of a mobile home roof having trusses 70 like that of FIG. 7. The discussion of FIG. 10 above also applies substantially to FIG. 12.

Figure 13:
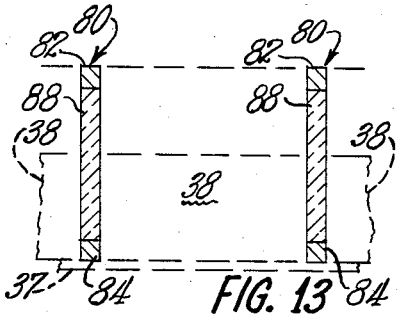

FIG. 13 shows a fragmentary sectional view of a mobile home roof having trusses 80 like that of FIG. 8, two of the trusses being shown. Ceiling board 37 is secured to the lower beams 84 of the trusses, and glass fiber insulation batts 38 are installed between the trusses 80 above the ceiling board 37. By way of example, the trusses 80 might be mounted on sixteen-inch centers and have a width of one and one-half inches. The batts 38, which are compressible, might have a nominal width of fifteen inches. It will be observed that with this arrangement, a vertical heat flow path through each truss 80 passes through the plastic foam insulation 88, and the insulation 88 of each truss 80 is in firm engagement on opposite sides respectively with the batts 38 all along the truss.

Figure 14:
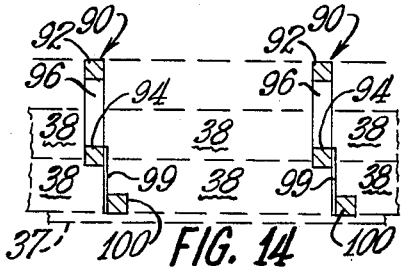

FIG. 14 shows a fragmentary sectional view of a mobile home roof having trusses 90 like that of FIG. 9, two of the trusses being shown. Ceiling board 37 is secured to the lower beams 100 of the trusses, and glass fiber insulation batts 38, in two layers, are installed between the trusses 90 above the ceiling board 37. By way of example, the trusses 90 might be mounted on sixteen-inch centers and have a width of one and one-half inches at the beams 92 and 94. The upper batts 38, which are compressible, might have a nominal width of fifteen inches, and the lower batts 38 might have a nominal width of sixteen and one-half inches. It will be observed that with this arrangement, although the upper batts 38 on opposite sides of a truss 90 are held apart by the posts 96-98, the lower batts 38 on opposite sides of the plates 99 are in firm engagement with each other all along the truss except at the plates 99, and a vertical heat flow path through the beams 92 and 94 of the truss passes through one of the lower batts 38.

Various modifications may be made in the structures shown and described without deparing from the scope of the invention as set forth in the following claims. For example, in the embodiment of FIG. 1, half the struts 34 could be omitted in the manner half the struts 57 in the embodiment of FIG. 5 are eliminated in the embodiment of FIG. 7. Further, the upper curved beams of the trusses could be straight, or could be two straight beams having an obtuse angle therebetween.

We claim:

1. An insulated trussed roof construction comprising a plurality of horizontally spaced, transversely aligned trusses and a plurality of fibrous insulation batts disposed respectively between pairs of adjacent trusses, each truss comprising an upper beam, a straight horizontally extending intermediate beam, and a straight horizontally extending lower beam vertically aligned with each other and having substantially equal overall lengths measured horizontally, a plurality of horizontally spaced vertical posts connecting the upper beam and the intermediate beam, a pair of opposite end posts respectively joining opposite end portions of said intermediate and lower beams, a plurality of metal struts spaced along the intermediate and lower beams on an outer side thereof between said end posts and connecting the intermediate and lower beams, and insulation material extending horizontally between said end posts and extending vertically between the intermediate and lower beams.

2. An insulated trussed roof construction as claimed in claim 1 wherein the insulation batts and the insulation material are glass fiber insulation.

3. A truss of the roof construction of claim 1.

4. A truss as claimed in claim 3 wherein the insulation material is glass fiber insulation.

* * * * *